United States Patent [19]

Waitz

[11] Patent Number: 4,593,903

[45] Date of Patent: Jun. 10, 1986

[54] VARIABLE WEIGHT EXERCISING DEVICE

[76] Inventor: Larry D. Waitz, 182 Earle Ave., Lynbrook, N.Y. 11563

[21] Appl. No.: 522,803

[22] Filed: Aug. 12, 1983

[51] Int. Cl.[4] ..... A63B 11/02

[52] U.S. Cl. ..... 272/122

[58] Field of Search ..... 272/137, 123, 122, 73, 272/142, 93, 902, 67, 68, 124

[56] References Cited

U.S. PATENT DOCUMENTS

| | | | |
|---|---|---|---|
| 201,174 | 3/1878 | Folk | 272/124 |
| 257,929 | 5/1882 | Folk | 272/124 |
| 1,316,683 | 9/1919 | Calvert | 272/122 |
| 2,509,810 | 5/1950 | Core | 272/122 |

FOREIGN PATENT DOCUMENTS

| | | | |
|---|---|---|---|
| 338610 | 5/1904 | France | 272/122 |

*Primary Examiner*—Richard J. Apley
*Assistant Examiner*—Robert Bahr

[57] ABSTRACT

A variable weight exercising device has a central tube with end caps removably secured to both ends. A number of concentric tubular weights are engaged and secured between the end caps by annular rims or steps in the medial faces of the end caps. An elastic resilient cord may be passed through the length of the central tube to provide a number of additional applications for the basic exercising device.

3 Claims, 8 Drawing Figures

VARIABLE WEIGHT EXERCISING DEVICE

SUMMARY OF THE INVENTION

An exercising device is disclosed that, in its simplest form, is a hand weight comprising a central tube having end caps removably secured to both ends, and a number of concentric tubular weights that are engaged and secured between the end caps by annular rims or steps in the medial faces of the end caps. Conventional barbell weights may be attached to the device by means of adaptors threaded on to the end of the end caps. In another embodyment of the device, holes through both end caps allow a cord to pass through the device. Thus the device can be used as a weighted jump-rope handle. Similarly, a loop of resilient cord passing through two of the devices can be used in a manner similar to a conventional chest-expander apparatus. In a third embodyment of the invention, two of the devices are rotatably mounted in an offset relation to one another, at opposite ends of a connector bar, so as to allow the use to exercise by moving the devices in a motion similar to pedaling a bicycle with one's hands.

DETAILED DESCRIPTION

Figure 1:
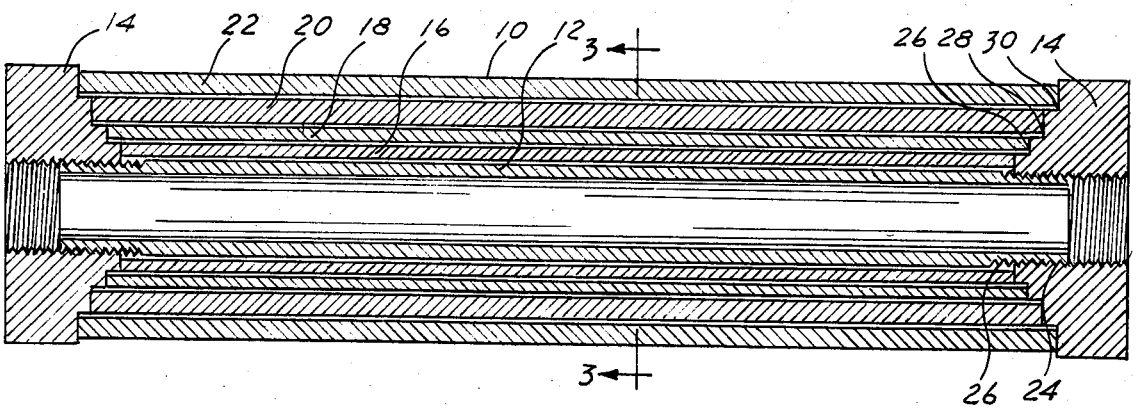
FIG. 1 is a cross sectional view of the exercising device.
Figure 2:
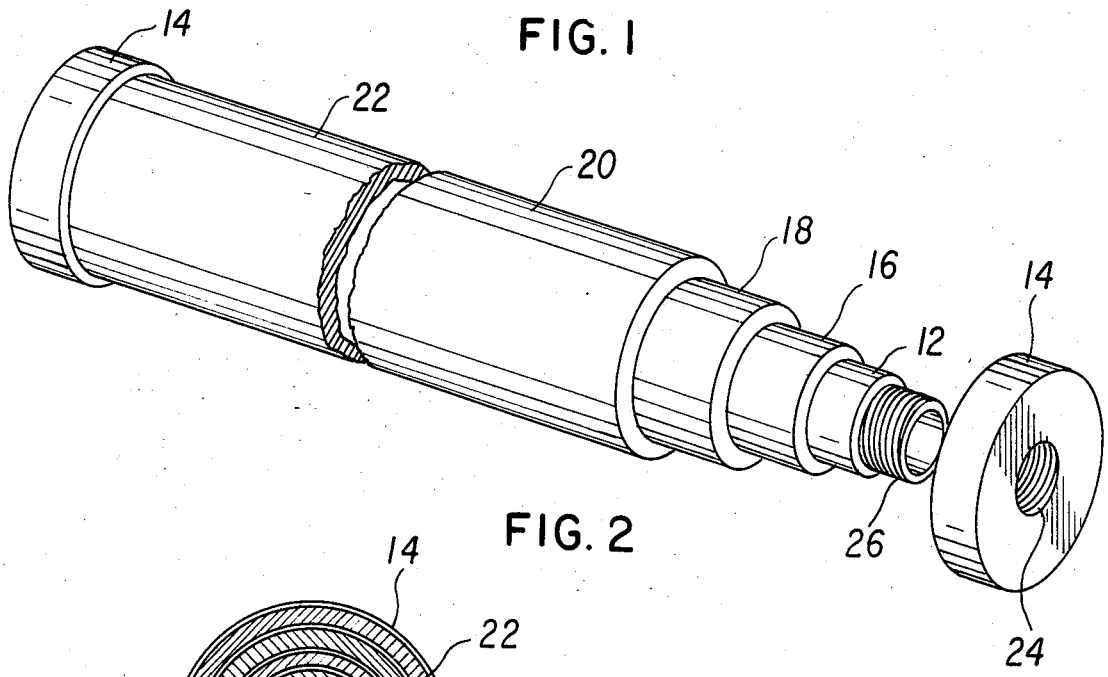
FIG. 2 is an exploded prospective view of the exercising device.
Figure 3:
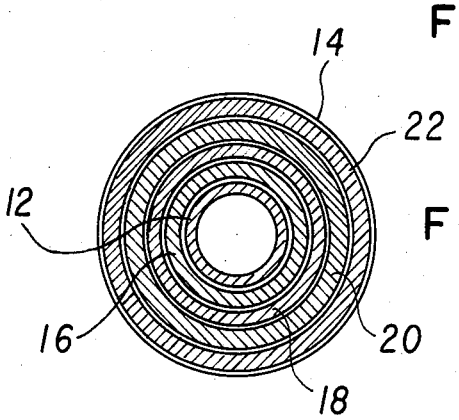
FIG. 3 is a cross sectional view perpendicular to that shown in FIG. 1.

Turning to FIG. 1, an exercising device is disclosed generally shown by the hand weight 10. The device comprises a central tube or elongated member 12. End caps 14 are threaded on to both ends of the tube 12. In addition, a series of concentric tubular weights 16, 18, 20, and 22 may be slipped over the central tube and secured in position by concentric annular grooves or steps 26, 28, and 30 in the medial faces of both end caps. The length and diameter of each tubular weight are established to allow the tubular weights to be nested within each other, as shown in FIGS. 2 and 3, and to firmly seat the ends of the tubular weights against the steps or grooves in the medial faces of the end caps.

The device can be used with any combination of the weights. For example, in one embodiment of the invention the central tube weighs one pound; each end cap weighs one-half pound; two of the concentric tubular weights weigh one pound; and the other two concentric tubular weights weigh three pounds. Thus, the total weight of the device can be varied from two to ten pounds, in one-pound increments, simply by unscrewing one of the end caps and adding or removing one or more of the concentric tubular weights. In addition to allowing for variation in weight, the device allows the user to vary the diameter of the grip by selecting the appropriate outermost concentric tubular weight to fit the size of the user's hand.

Figure 4:
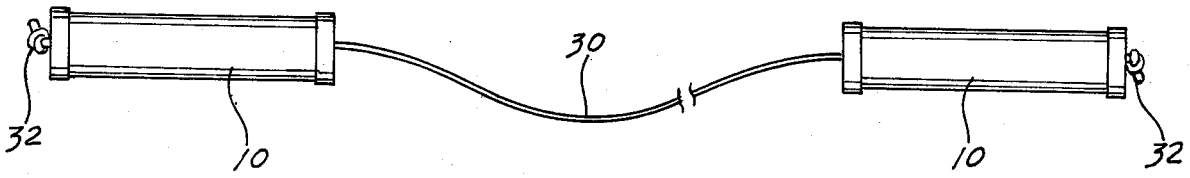
FIG. 4 shows another application of the invention as weighted jump-rope handles.

Aside from use as a simple hand weight, the device offers a number of additional applications. In the preferred embodiment of the invention, the end caps have holes coaxially oriented with the longitudinal axis of the central tube to allow a cord or rope to pass through the length of the device. For example, as shown in FIG. 4, the device can be used as a weighted jump-rope handle by passing one end of the jump-rope 30 through the device and then tying a large knot 32 in the rope to prevent it from slipping back through the device. Alternatively, a grommet placed in the hole in the end cap could be employed to retain the cord.

Figure 5:
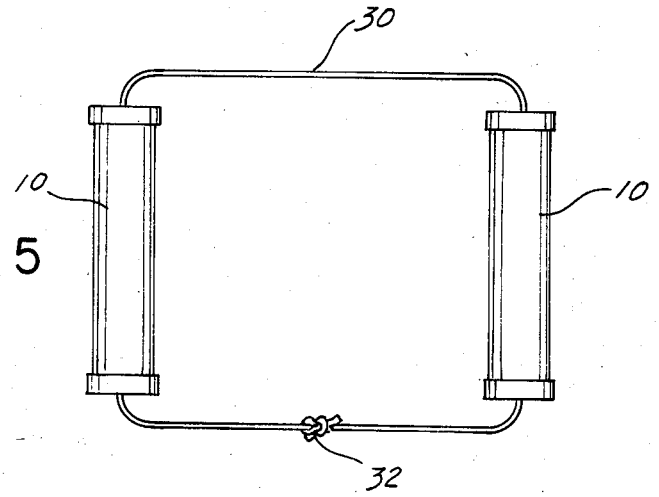
FIG. 5 shows another application of the invention as a chest-expander.

In another application, a length of elastic cord 30 can be passed through two of the devices and then knotted 32 to form a loop, as shown in FIG. 5. This results in an apparatus similar to a conventional chest-expander in which the loop of elastic cord 30 provides a resistive force as the user moves the devices farther apart. In a variation of this application, a knotted loop of elastic cord is passed through a single device. The user stands on the bottom of the loop while moving the device upward in a vertical motion.

Figure 6:
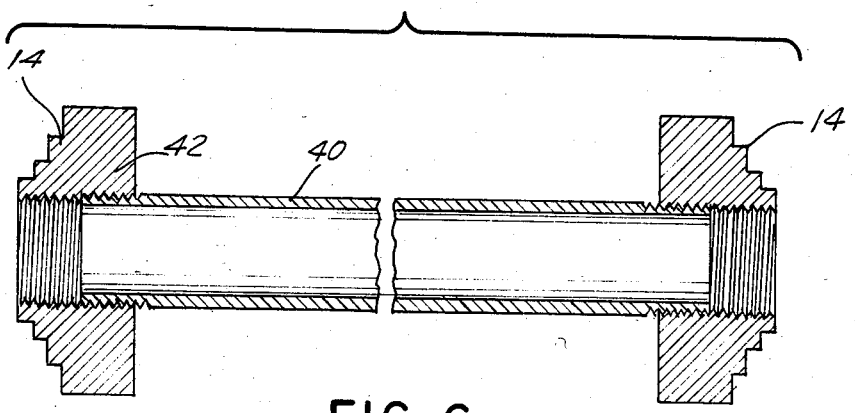
FIG. 6 is a cross sectional drawing showing a connector used to connect together the end caps of two exercising devices.

FIG. 6 shows a connector 40 threaded into the external faces of the end caps of two devices. By means of such a connector, the user can rigidly connect two of the devices together. Depending upon the length of the connector, two devices can simply be abutted end to end; or a connector having a greater length can be used as a handle or bar separating two devices.

Figure 7:
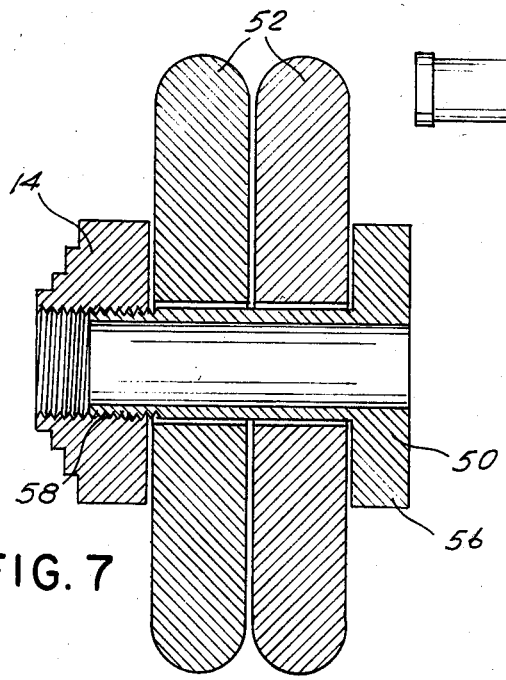
FIG. 7 is a cross sectional view showing an adaptor used to attach conventional barbell weights to the end cap of the exercising device.

FIG. 7 shows an adaptor 50 that can be threaded on to the end cap of the device to accommodate conventional barbell weights 52. The shaft 58 of the adaptor passes through the center hole of the barbell weight, and the adaptor flange 56 secures the barbell weight to the exterior face of the end cap.

Figure 8:
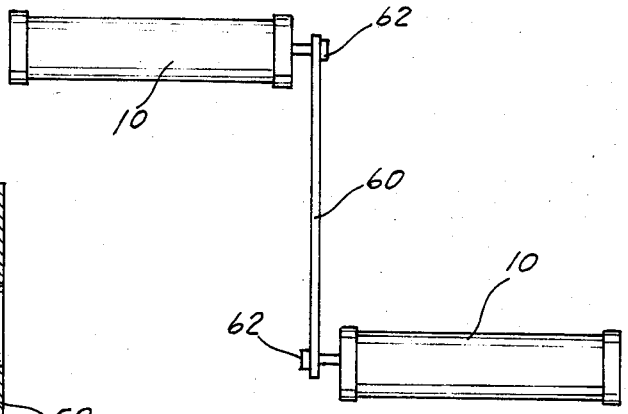
FIG. 8 shows another application of the invention in which two exercising devices are mounted on opposing ends of a crank member.

FIG. 8 shows another application of the invention in which two of the devices 10 are connected together in an offset relation by a crank member 60. Pivot means 62, threaded into the end caps are employed to connect the devices to the crank member while allowing the devices to freely rotate about their longitudinal axis. This apparatus is used by taking one device in each hand and performing a motion similar to pedaling a bicycle. However, unlike a bicycle, the present apparatus does not have a fixed center of rotation for the devices.

In another variation, a crank member is employed having a length that extends as a tensile force is exerted between the ends of the crank. In this embodiment, the shaft of the crank has a two-piece construction consisting of a member having a longitudinal channel; and a second member constrained by the channel but capable of sliding extension from the channel. Thus, the length of the crank will vary as the channel member and sliding member longitudinally slide with respect to each other. A spring may be connected between the channel and sliding members to provide a resistive force as the sliding member extends from the channel member. This arrangement provides the advantage of combining the effect of lifting the hand weights with the additional effort necessary to extend the length of the crank while rotating the entire apparatus in a peddling motion.

I claim:

1. An exercising device comprising:

an elongated member;

end caps removably secured to both ends of the elongated member, said end caps having a plurality of concentrically stepped annular rims on the medial face of the end cap concentric with the longitudinal axis of the elongated member; and a plurality of concentric tubular weights, each weight having a length and diameter fixed so that the ends of the weight are engaged and secured by the annular rims on the medial faces of each of the end caps.

2. The exercising device of claim 1 wherein the elongated member is removably secured to the end caps by means of threads on the elongated member and end caps.

3. The exercising device of claim 1 wherein the elongated member comprises a tube, and wherein each end cap has a hole coaxially oriented with said tube having an inside diameter sufficiently large to allow a cord to pass through the exercising device.

* * * * *